US006028279A

United States Patent [19]

Suryan et al.

[11] Patent Number: 6,028,279

[45] Date of Patent: Feb. 22, 2000

[54] LIGHTED PUSH BUTTON SWITCH

[75] Inventors: Mark J. Suryan, Bothell; Gary Gunell, Woodinville, both of Wash.

[73] Assignee: Korry Electronics Co., Seattle, Wash.

[21] Appl. No.: 09/257,229

[22] Filed: Feb. 25, 1999

Related U.S. Application Data

[60] Provisional application No. 60/076,109, Feb. 27, 1998.

[51] Int. Cl.[7] ..... H01H 13/56

[52] U.S. Cl. ..... 200/524; 200/573; 200/533; 200/341

[58] Field of Search ..... 200/4, 520–524, 200/528, 529, 533, 537, 573, 574, 341, 5 R, 18

[56] References Cited

U.S. PATENT DOCUMENTS

| | | | |
|---|---|---|---|
| 3,153,714 | 10/1964 | Bury | 200/167 |
| 3,172,296 | 3/1965 | Tancred | 74/103 |
| 3,306,992 | 2/1967 | Ast | 200/5 |
| 3,340,375 | 9/1967 | Kiesel et al. | 200/153 |
| 3,345,490 | 10/1967 | Gerjets et al. | 200/159 |
| 3,776,049 | 12/1973 | Emery | 74/110 |
| 3,839,607 | 10/1974 | Ogihara | 200/33 R |
| 3,866,006 | 2/1975 | Westram | 200/153 LA |
| 4,050,670 | 9/1977 | Borg et al. | 251/4 |
| 4,227,059 | 10/1980 | Ogawa | 200/153 G |
| 4,543,459 | 9/1985 | Hayashida | 200/67 D |
| 4,654,494 | 3/1987 | Wüthrich | 200/337 |
| 4,758,694 | 7/1988 | Burdick | 200/50 C |
| 4,916,269 | 4/1990 | Spazierer et al. | 200/408 |
| 5,015,811 | 5/1991 | Moriyama et al. | 200/521 |
| 5,057,657 | 10/1991 | Skulic | 200/5.7 |
| 5,202,607 | 11/1993 | Cummings et al. | 200/524 |
| 5,727,675 | 3/1998 | Leveque et al. | 200/524 |

*Primary Examiner*—Michael Friedhofer
*Attorney, Agent, or Firm*—Christensen O'Connor Johnson & Kindness PLLC

[57] ABSTRACT

A push-button switch (20) having a housing (26) is disclosed. The push-button switch includes a cap assembly (22) reciprocably mounted within the housing. The push-button switch also includes at least a first subminiature switch (64) that is actuatable between an open circuit position and a closed circuit position by a plunger (72) operatively connected thereto. The subminiature switch is disposed within the housing such that actuation of the plunger is substantially normal to the motion of the cap assembly. The push-button switch also includes an actuator (44) disposed within the housing and extending between the cap assembly and the plunger. The actuator sequentially pivots about first and second pivot points in response to a linear force to actuate the subminiature switch between the open and closed circuit position.

37 Claims, 5 Drawing Sheets

LIGHTED PUSH BUTTON SWITCH

This application claims the benefit of U.S. Provisional Patent Application Ser. No. 60/076,109, filed on Feb. 27, 1998.

FIELD OF THE INVENTION

The present invention relates generally to electrical switches and, more particularly, to push button switches.

BACKGROUND OF THE INVENTION

The operator's compartment of most commercial vehicles, such as the cockpit of an airplane, generally includes at least one control panel. The control panel includes a plurality of high and/or low current switches that are in communication with a variety of electrical or hydraulic systems. Actuation of low current switches produces a relatively low current output to activate the switching action of a larger driver circuit. Such driver circuits are used to actuate a variety of systems, such as the landing gear or running lights of the vehicle.

High and low current switches currently available for such systems include both contact and contactless switches. Contact switches generally include a canister, a subminiature switch, an actuator and a tactile response mechanism. Located at one end of the canister is a cap assembly. Mounted at the other end is a terminal plate having a plurality of pins extending therethrough. Sub-miniature switches for such switches include a plunger reciprocally mounted to the subminiature switch. The plunger actuates the switch between an open circuit and closed circuit position in response to a linear movement. Such subminiature switches are mounted within the canister such that movement of the plunger is coaxial with the movement of the actuator.

Typical actuators used for contact switches include spring loaded force cap actuators that reciprocate within a sleeve disposed within the canister. The actuator is coupled to the movement of the cap assembly, such that the actuator translates in a direction that is parallel with the cap. As a result, displacement of the plunger must be aligned in a direction that is parallel to the displacement of the cap and actuator stroke.

Currently available contactless switches generally include a magnet and a sensor that is sensitive to magnetic forces to produce electronic control pulses. In a typical contactless switch, the magnets are permanently mounted to a device that is either rotated or linearly translated into close proximity with the sensors to change the state of the switch. In contactless switches having linear translations of magnets, the switch may also include a separate tactile mechanism coupled to the translation of the magnets to produce a tactile response while changing the state of the switch. A tactile response is desirable because it allows the operator to confirm actuation of a particular system without requiring visual confirmation. Although both contact and contactless switches are effective at changing the state of a switch, they are not without problems.

First, because the subminiature switches must be orientated within the canister such that its plunger stroke is parallel with the cap and actuator stroke, such switches have a rigid pin pattern definition. This is undesirable because it does not allow electric interface connections to be modified for an existing subsystem installation. Second, because the tactile response is typically a separate mechanism, such a switch is complex to assemble and maintain. Finally, for alternate action switches, hold down of the switch into either the opened or closed circuit positions is accomplished by a separate latching mechanism. Therefore, such a switch is also more complex and expensive to manufacture.

Thus, there exists a need for a switch that not only produces an anticipated tactile response, but is also economical to manufacture, has a high degree of reliability and satisfies the performance expectations of the end user.

SUMMARY OF THE INVENTION

In accordance with the present invention, a push button switch is provided. The push button switch includes a housing, a cap assembly reciprocally mounted within the housing and at least a first subminiature switch. The subminiature switch is actuatable between an open circuit position and a closed circuit position by a plunger operatively attached to the subminiature switch. The subminiature switch is disposed within the housing such that actuation of the plunger is substantially normal to the motion of the cap assembly. The push button switch also includes an actuator disposed within the housing and extending between the cap assembly and the plunger. The actuator is pivotable about the first and second pivot points in response to a linear input, thereby actuating the subminiature switch between the open and closed circuit positions.

In accordance with further aspects of this invention, the push button switch further includes a tactile response mechanism disposed within the housing and in contact with the actuator. The tactile response mechanism produces a tactile response when the subminiature switch is actuated between the open and closed circuit positions. The tactile response mechanism includes a tactile housing and a slide member reciprocally received within the tactile housing. The slide member is in sliding contact with the actuator for simultaneous tactile response and actuation of the subminiature switch between the open and closed circuit positions.

In accordance with other aspects of this invention, the push button switch also includes a hold down mechanism disposed within the housing and selectively in contact with a portion of the actuator to selectively lock the switch into the open circuit position.

In accordance with still yet other aspects of this invention, the first pivot point is located at the actuator and plunger contact, such that as the actuator pivots about the first pivot point, the actuator simultaneously translates within the housing along an axis that is substantially parallel with the motion of the plunger.

A push button switch formed in accordance with the present invention has several advantages over currently available switches. The orientation of the subminiature switch plunger within the canister allows the end user to rearrange the external pin pattern to accommodate a variety of mating connectors. This results in a switch that is convertible to accommodate multiple end user requirements and, therefore, is more versatile. The combination of the tactile response mechanism with the actuator minimizes the possibility of non-simultaneous actuation of the subminiature switch. Thus, a switch formed in accordance with the present invention is also more reliable. Furthermore, a switch formed in accordance with the present invention has fewer parts and, therefore, is less costly to manufacture. Finally, such a switch uses a compound, dual axis of rotation actuator to provide precise mechanism timing. Thus, a push button switch formed in accordance with the present invention is economical to produce, has high reliability and produces the customary and anticipated tactile response while changing the state of the switch.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1A:
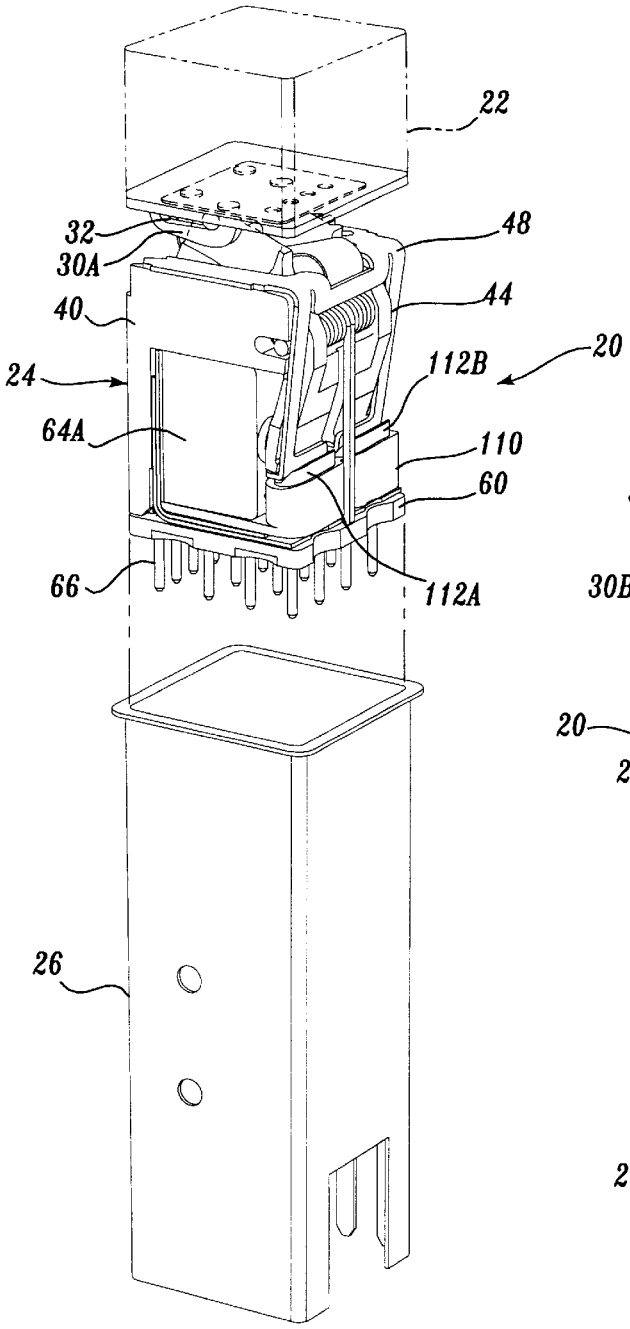
FIG. 1A is a perspective view of a push button switch formed in accordance with the present invention with the switch assembly removed from the canister and the cap assembly shown in phantom for clarity.
Figure 1B:
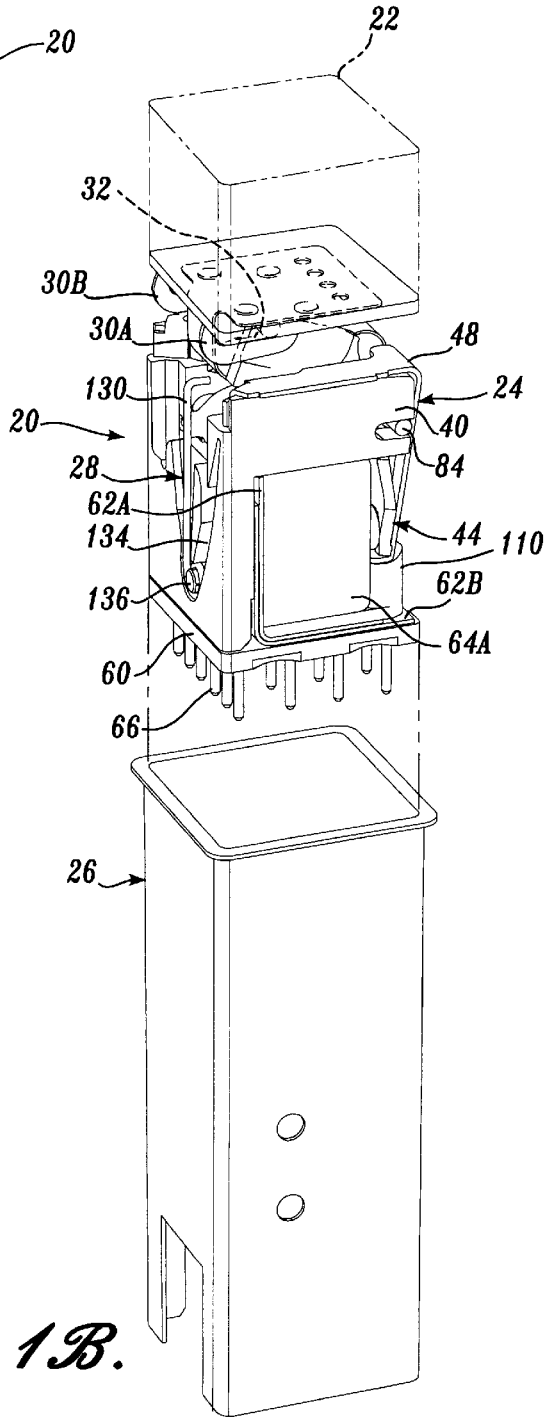
FIG. 1B is a perspective view of a push button switch formed in accordance with the present invention and shown rotated 90° from the view illustrated in FIG. 1A.
Figure 2:
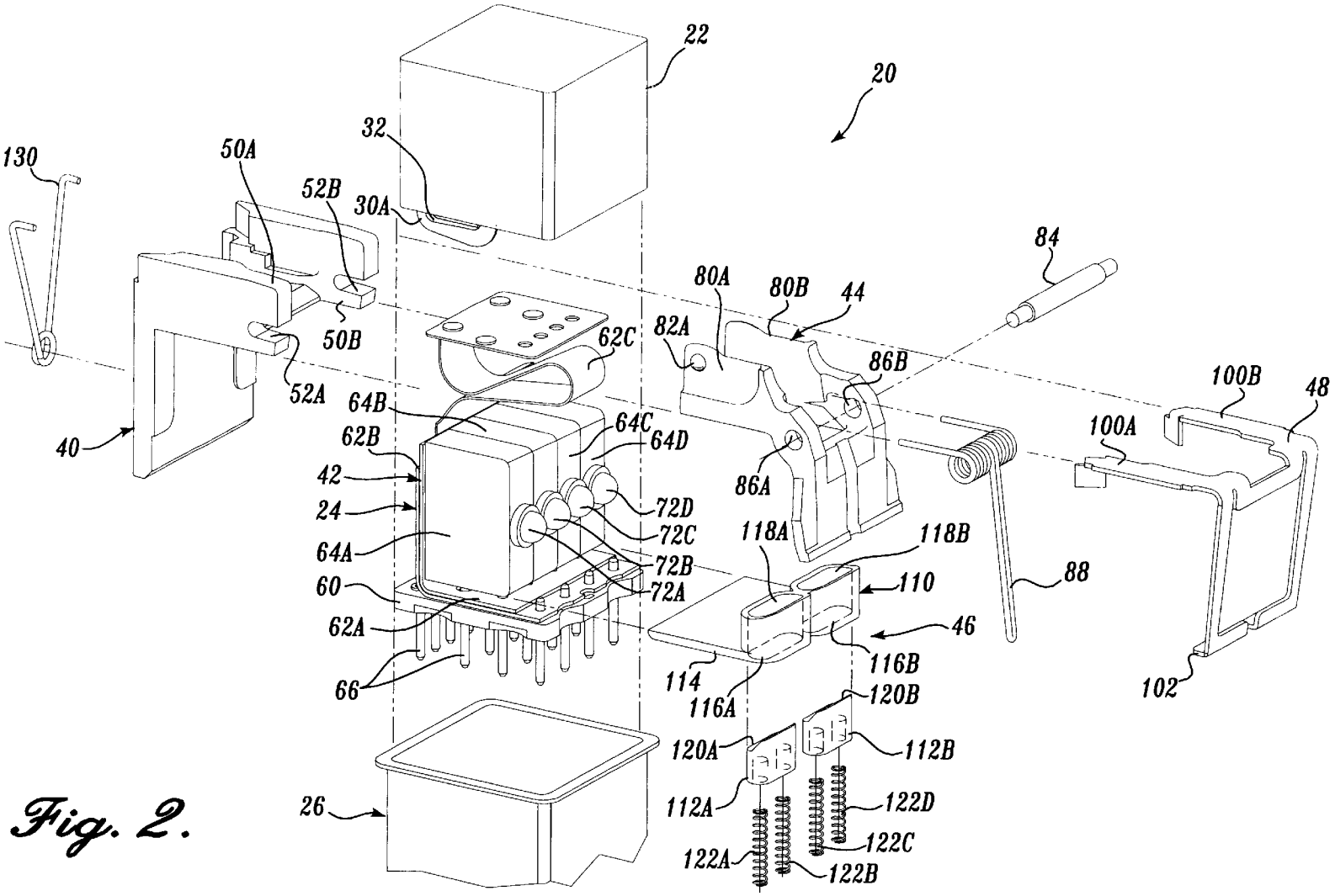
FIG. 2 is an exploded view of a push button switch formed in accordance with the present invention showing the major elements of the switch.

FIGS. 1A–2 illustrate a preferred embodiment of a switch 20 constructed in accordance with the present invention. The switch 20 is designed to be used with a "pokehome" style termination header and can be installed in a variety of control panels (not shown) of a commercial vehicle, such as an airplane. Preferably, such switches 20 are used within the vehicle to actuate a variety of systems. Also, such switches may be configured as either a momentary switch, wherein the switch state is maintained as long as a load is applied to the switch cap, or an alternate action switch. While normally used in a substantially horizontal orientation, for ease of illustration and clarity, the switch 20 is shown in a vertical orientation. Therefore, the terminology vertical, upper, lower, etc., should be construed as descriptive, and not limiting.

The switch 20 includes a well-known cap assembly 22, a switch module 24 and a switch can or housing 26. For an alternate action switch, the switch 20 also includes a hold-down mechanism 28 attached to the switch module 24. The well known switch can 26 is a hollow and rectangularly shaped canister that is suitably extruded from a lightweight, high-strength material, such as aluminum. The switch can 26 is sized to slidably receive the switch module 24 therein. The switch module 24 may be secured within the switch can 26 by formed tab features on the switch can 26 or by well-known releasable fasteners (not shown), such as lugs pivotably attached to opposite sides of the switch module for selective engagement within corresponding holes (not shown) formed in the switch can 26.

The cap assembly 22 is also a well-known assembly and is suitably injection-molded from a thermoplastic. The lower surface of the cap assembly 22 includes integrally formed and downwardly depending attachment arms 30*a* and 30*b*. The attachment arms 30*a* and 30*b* are horizontally aligned and includes an elongate slot 32 extending through the width of each arm 30*a* and 30*b*. Each slot 32 is sized to slidably receive a portion of the switch module 24 therein to selectively fasten the cap assembly 22 to the switch module 24, as is described in greater detail below.

As may be best seen by referring to FIG. 2, the switch module 24 includes a frame 40, a circuit assembly 42, a rocker 44, a tactile mechanism 46 and a foundation spring 48. The frame 40 is an inverted L-shaped member that is suitably injection-molded from a thermoplastic. The return of the frame 40 is bifurcated to define a pair of parallel arms 50*a* and 50*b* projecting normally from the spine thereof. Each arm 50*a* and 50*b* includes a rearwardly extending slot 52*a* and 52*b*. The slots 52*a* and 52*b* extend from the forward-facing surface of each arm 50*a* and 50*b* rearwardly for a predetermined distance towards the spine of the frame 40. The slots 52*a* and 52*b* are sized to slidably receive a slide pin 84, that slides through a portion of the rocker 44 therein to actuate the circuit assembly 42, as is described in greater detail below.

The circuit assembly 42 includes a terminal plate 60, a plurality of flex circuits 62*a*–62*c* and a plurality of subminiature switches 64*a*–64*d*. The square-shaped terminal plate 60 is suitably injection-molded from a high-temperature plastic and includes a plurality of well-known terminal pins 66. Each terminal pin 66 is press-fitted into a vertically extending hole (not shown) formed in the terminal plate 60. Each pin 66 may be permanently attached to the terminal plate 60 by a well known method, such as soldering. The pins 66 are in electrical communication with at least one of the subminiature switches 64*a*–64*d* by the well known flex circuits 62*a*–62*c*. A variety of connection patterns between the pins 66 and the subminiature switches 64*a*–64*d* by the flex circuits 62*a*–62*c* are within the scope of the present invention. As a non-limiting example, one end of the first flex circuit 62*a* is soldered to and in communication with a predetermined number of pins 66. The other end of the first flex circuit 62*a* is soldered to and is in communication with the subminiature switches 64*a*–64*d*. Similarly, the second flex circuit 62*b* is soldered to and in communication with a predetermined number of the terminal pins 66, while and the other end thereof is soldered to and in communication with the subminiature switches 64*a*–64*d*. Finally, one end of the third flex circuit 62*c* is soldered to and in communication with a predetermined row of terminal pins 66. The other end of the third flex circuit 62*c* is electrically connected to well-known lamp circuits (not shown) located in the cap assembly 22. Thus, as configured, each flex circuit 62*a*–62*c* carries a level of current from the terminal pins 66 to at least one of the subminiature switches 64*a*–64*d* and/or the cap assembly 22 and back to the pins 66.

Although the preferred embodiment of a switch formed in accordance with the present invention includes a total of three flex circuits, a switch having more or fewer flex circuits, such as four or two flex circuits, is also within the scope of the present invention. Furthermore, although flex circuits are preferred in establishing electrical communication between the terminal pins and the subminiature switches, other connection devices, such as ribbon cables, insulated individual leads or molded-in circuit traces, are also within the scope of the present invention.

Still referring to FIG. 2, each subminiature switch 64*a*–64*d* has the capability of switching currents as low as 10 milliamps to a high of 8 amps. As a non-limiting example, such a switch includes single pull double-throw (SPDT), double break switches. Each subminiature switch 64*a*–64*d* includes a subminiature switch actuator 72. Preferably, each subminiature switch actuator 72*a*–72*d* is a well known contact subminiature switch actuator, such as a plunger. Although contact subminiature switches 64*a*–64*d* are preferred, other current switching devices, such as a contactless switch, are also within the scope of the present invention. Therefore, each actuator 72*a*–72*d* a sensor-type actuator, such as a Hall Effect sensor, is also within the scope of the present invention. Additionally, although four subminiature switches are preferred, more or fewer subminiature switches, such as five or one subminiature switch, are also within the scope of the present invention.

The subminiature switches 64*a*–64*d* are orientated within the switch module 24, such that the axis of travel for each actuator plunger is substantially normal to the motion of the cap assembly 22. As a non-limiting example, the cap assembly 22 moves linearly in the vertical direction and, therefore, the axis of travel for the plunger is horizontal. Furthermore, the subminiature switches 64*a*–64*d* are orientated within the switch module 24, such that they are in contact with the rocker 44 for simultaneous actuation, as is described in greater detail below.

The rocker 44 is an L-shaped member suitably injection-molded from a thermoplastic. The rocker 44 includes a forked upper end defining a pair of horizontally aligned arms 80*a* and 80*b*. The arms 80*a* and 80*b* project rearwardly and each includes an integrally formed semicircular protrusion 82*a* and 82*b*. The protrusions 82*a* and 82*b* extend outwardly in opposite directions from the sides of each arm 80*a* and 80*b*. The protrusions 82*a* and 82*b* are sized to be slidably received within the slots 32 of the cap assembly 22. The slots 32 and the protrusions 82*a* and 82*b* cooperate to smoothly transfer a linear load applied to the cap assembly 22 to the rocker 44 to change the state of the switch module 24, as is described in greater detail below.

The rocker 44 is pivotably and slidably attached to the frame 40 by a pivot and slide pin 84. The pivot and slide pin 84 is a substantially cylindrical-shaped member and is slidably received within a pair of horizontally aligned holes 86*a* and 86*b* extending through the thickness of the arcuate section of the rocker 44. A retention spring 88, such as a torque spring, is pinned between the arms 80*a* and 80*b* of the rocker 44 by the pivot and slide pin 84. The retention spring 88 applies a substantially constant load to the rocker 44 to assist in biasing the lower end of the rocker 44 against the subminiature switch actuators 72*a*–72*d*.

The inverted L-shaped foundation spring 48 is suitably formed from a high-strength spring material. The return of the foundation spring 48 is bifurcated to define rearwardly projecting attachment arms 100*a* and 100*b*. The attachment arms 100*a* and 100*b* may be fastened to the upper end of the frame 40 by well-known fasteners (not shown), such as screws, extending vertically through each arm 100*a* and 100*b* and into the upper portion of the frame 40. Thus, the foundation spring 48 is cantilevered to the frame 40. The arcuate portion extending between the attachment arms 100*a* and 100*b* in the spine of the foundation spring 48 has a predetermined amount of flexibility and preloads the foundation spring 48 when it is assembled to the circuit assembly 42. The tactile response of the switch 20 may be tuned by changing the stiffness of the arcuate portion to adjust the rigidity of the arcuate portion.

The lower edge of the downwardly depending spine of the foundation spring 48 includes a lip 102. The lip 102 is sized to envelope the lower edge of the rocker 44 to provide a durable wear surface to extend the usable life of the rocker 44 due to engagement with the tactile mechanism 46, as is described in greater detail below.

Still referring to FIG. 2, the tactile mechanism 46 includes a tactile base 110 and first and second tactile sliders 112*a* and 112*b*. The tactile base is suitably injection-molded from a thermoplastic and includes a planar support portion 114 and first and second tactile housings 116*a* and 116*b* integrally formed with one end of the support portion 114. The tactile housings 116*a* and 116*b* are horizontally aligned and project normally upward from one end of the support portion 114. Each tactile housing 116*a* and 116*b* includes a centrally located cavity 118*a* and 118*b* extending vertically therethrough. Each cavity 118*a* and 118*b* is sized to slidably receive one of the tactile sliders 112*a* and 112*b* therein.

Each tactile slider 112*a* and 112*b* is suitably injection-molded from a thermoplastic and is substantially oval in shape. The upper surface of each tactile slider 112*a* and 112*b* is contoured to define a ramp 120*a* and 120*b*. The tactile sliders 112*a* and 112*b* are slidably received within the cavities 118*a* and 118*b* of the tactile base 110, such that the ramp angle projects upwardly from the tactile housings 116*a* and 116*b*. Each tactile sliders 112*a* and 112*b* are reciprocally mounted within the tactile housings 116*a* and 116*b* on a pair of coil compression springs 122*a*–122*d*. The support portion 114 of the tactile base 110 is sized to be received between the lower surfaces of the subminiature switches 64*a*–64*d* and the flex circuit 62*a*. Thus, as assembled, the upper surfaces of the tactile sliders 112*a* and 112*b* project upwardly from the tactile base 110 and are sized and positioned to receive the lower ends of the rocker 44 and foundation spring 48 therein.

Figure 3B:
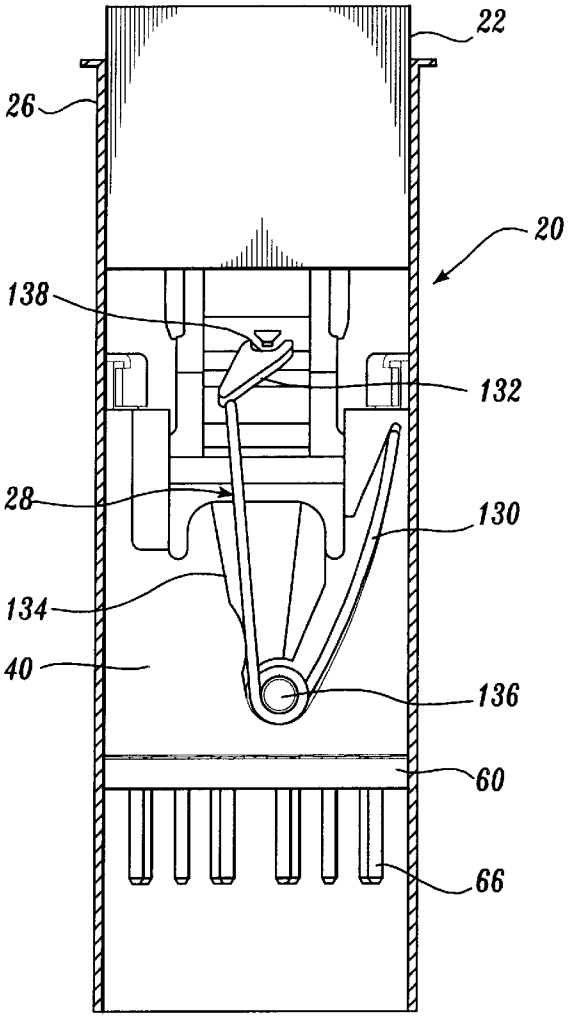
FIG. 3B is a rear-facing view of a push button switch formed in accordance with the present invention shown in the open circuit position with the canister partially cut away for clarity.

Referring now to FIGS. 1B and 3B, the hold down mechanism 28 will now be described in greater detail. For clarity and ease of illustration, only the major components of the switch are illustrated in FIG. 3B. The hold down mechanism 28 includes a heart guide wire 130 and a heart guide 132. The heart guide wire is a substantially V-shaped member sized to be received within a V-shaped recess 134 integrally formed in the rearwardly facing surface of the frame 40. The lower end of the heart guide wire 130 forms a circular loop that is sized to be received on a correspondingly shaped projection 136 integrally formed in the lower portion of the recess 134. One end of the heart guide wire 130 is received within a corresponding hole (not shown) formed in the upper end of the recess 134 to secure the heart guide wire 130 therein. The other free end of the heart guide wire 130 is sized for engagement with the heart guide 132 to selectively lock the switch 20 into a closed circuit position.

The heart guide 132 is integrally formed with the rearwardly facing surface of the rocker 44 and is disposed substantially midway between the first and second arms 80*a* and 80*b*. The upper surface of the substantially heart-shaped heart guide 132 includes a centrally located yoke or saddle portion 138. The yoke portion 138 is sized to lockingly receive the free end of the heart guide wire 130 therein to selectively hold the switch 20 in the closed circuit condition, as described in greater detail below.

Operation of the switch 20 of the present invention may be best understood by referring to FIGS. 3A–5B. The switch 20 has at least two distinct positions; an open circuit position and a closed circuit position.

Figure 3A:
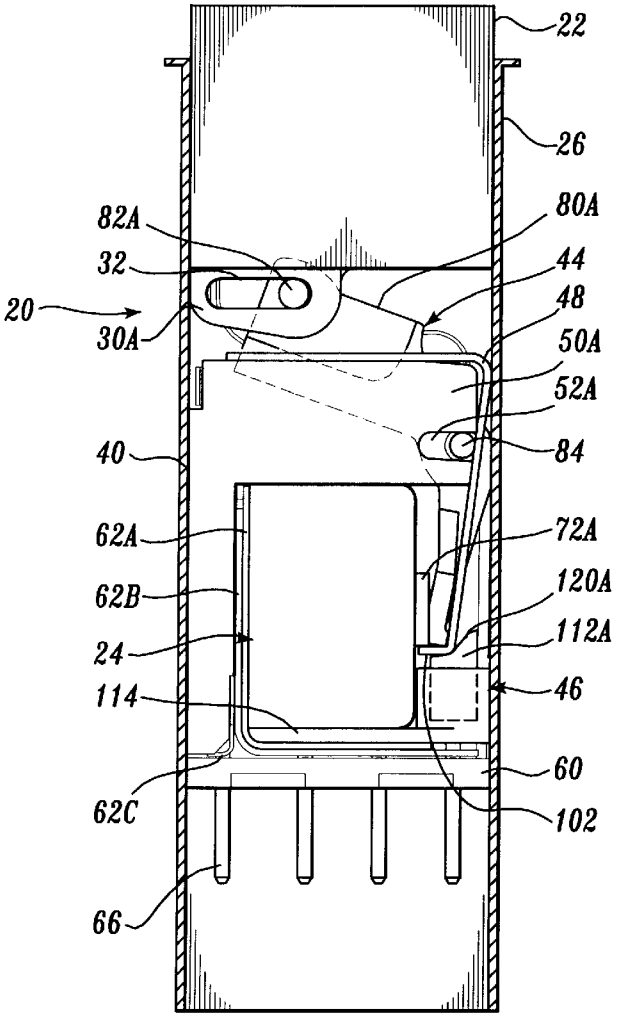
FIG. 3A is a side view of a push button switch formed in accordance with the present invention shown in the open circuit position and with the canister partially cut away for clarity.

The open circuit position may be best understood by referring to FIGS. 3A and 3B. In FIG. 3A, the lower end of the rocker 44 is displaced rearwardly against the subminiature switch actuator 72*a*–72*d* of each subminiature switch 64*a*–64*d*. The lower end of the rocker 44 is held against the subminiature switch actuator 72*a*–72*d* by the combination of the retention spring 88 and the tactile sliders 112*a* and 112*b*. As noted above, the retention spring 88 biases the lower end of the rocker 44 rearwardly against the subminiature switch actuators 72*a*–72*d*. As may be best seen by referring to FIG. 3A, the lip 102 of the foundation spring 48 surrounds the lower end of the rocker 44 and engages the upper surface of the tactile sliders 112*a* and 112*b*, thereby limiting wear on the lower end of the rocker 44 due to frictional contact with the tactile sliders 112*a* and 112*b*.

In the open circuit position, the free end of the heart guide wire 130 is positioned near the lower edge of the heart guide 132.

Figure 4B:
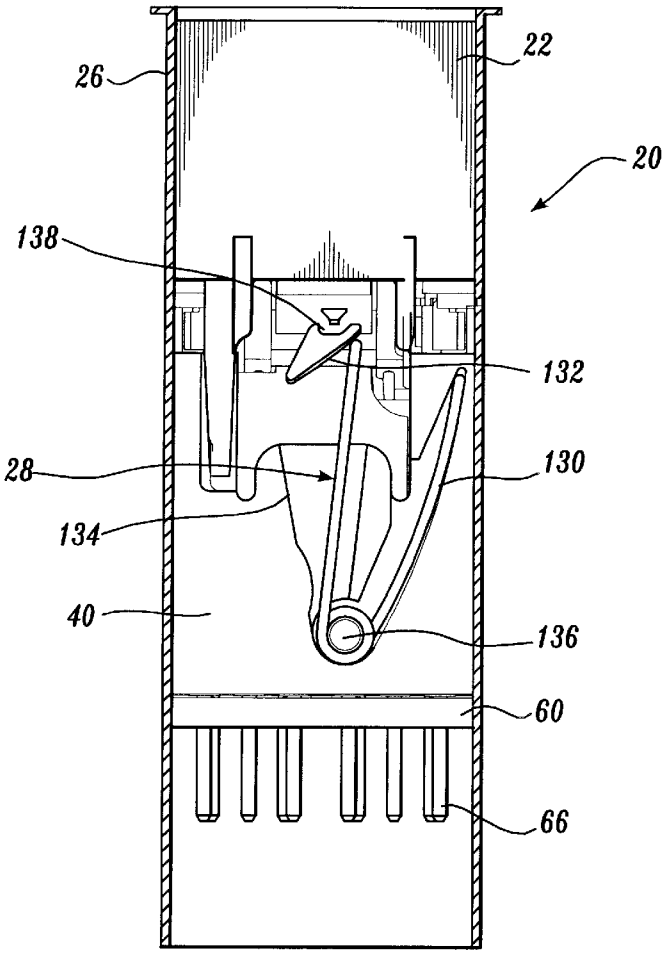
FIG. 4B is an end view of a push button switch formed in accordance with the present invention with the switch in the open circuit position and showing the position of the hold down mechanism corresponding to the position of the actuator of FIG. 4A with the canister partially cut away for clarity.
Figure 4A:
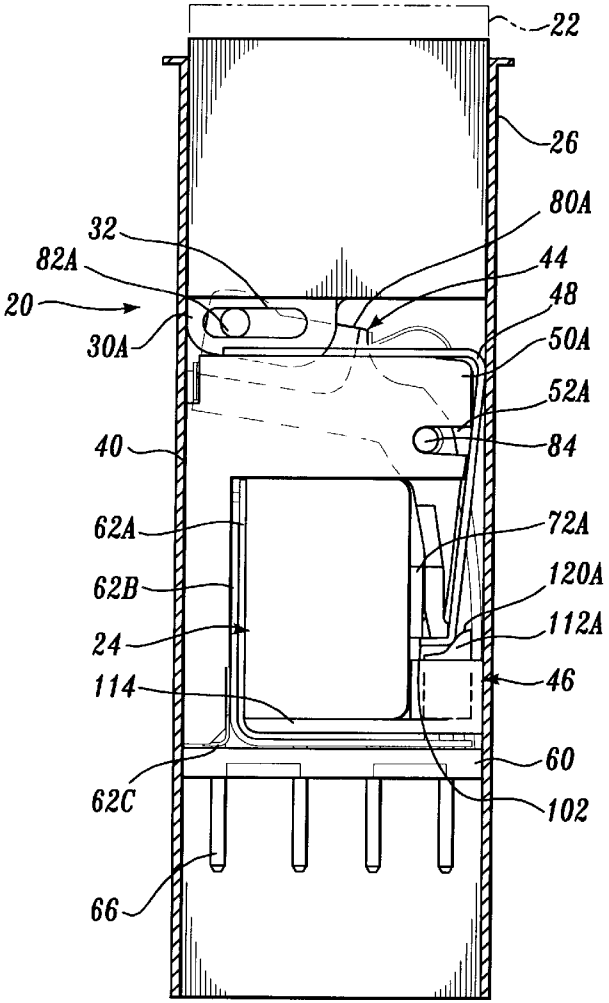
FIG. 4A is a side view of a push button switch formed in accordance with the present invention shown in the open circuit position with the actuator of the switch fully translated within the canister and the canister partially cut away for clarity.

Transition between the open circuit position and closed circuit position may be best understood by referring to FIGS. 4A and 4B. As seen in FIG. 4A, a downward linear load is applied to the upper surface of the cap assembly 22. As the cap assembly 22 translates downwardly within the switch can 26, the protrusions 82*a* and 82*b* of the rocker 44 slide rearwardly within the slot 32 of the attachment arms 30*a* and 30*b*. Additionally, the pivot and slide pin 84 also slides rearwardly within the slots 52*a* and 52*b* of the arms 50*a* and 50*b* of the frame 40. Simultaneously, the rocker 44 pivots about the contact point between the upper surface of the tactile sliders 112*a* and 112*b* and the lower edges of the rocker 44 and foundation spring 48. The lower end of the rocker 44 remains in contact with the subminiature switch actuators 72*a*–72*d* to maintain the switch 20 in the open circuit position. Thus, in response to a linear force applied to the cap assembly 22, the rocker 44 pivots about a first pivot point defined at the lower edge portion of the rocker 44 and simultaneously translates within the frame 40 along an axis that is substantially parallel to the motion of each subminiature switch actuator 72*a*–72*d*.

Motion of the heart guide wire 130 during this transition period may be best understood by referring to FIG. 4B. As the cap assembly 22 translates downwardly within the switch can 26, the free end of the heart guide wire 130 engages the lower right hand side of the heart guide 132, causing the free end of the heart guide wire to slide in a counter-clockwise direction and upwardly along the heart guide 132.

Figure 5B:
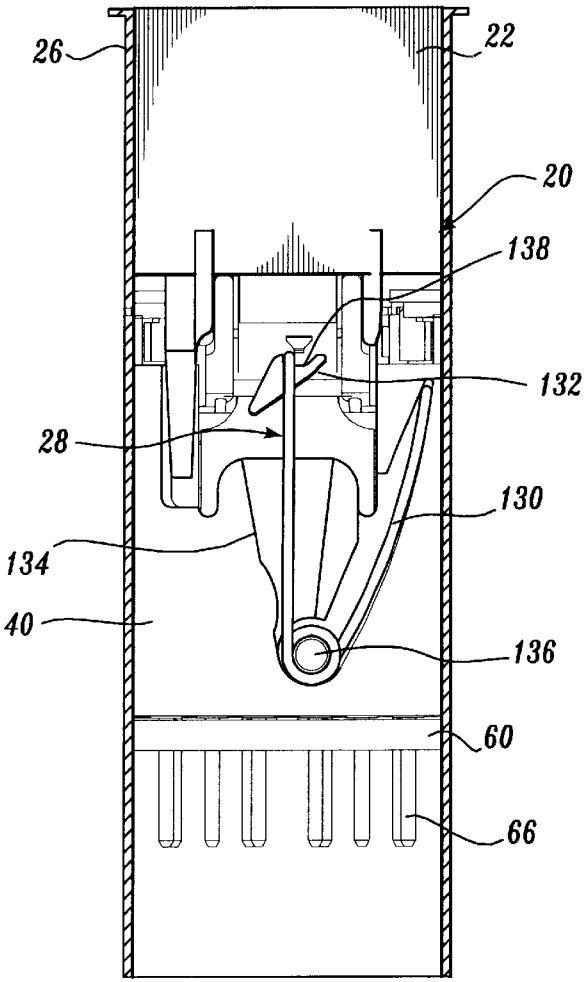
FIG. 5B an end view of a push button switch formed in accordance with the present invention shown in the open circuit position with the canister partially cut away to illustrate the positioning of the hold down mechanism in the closed circuit position.
Figure 5A:
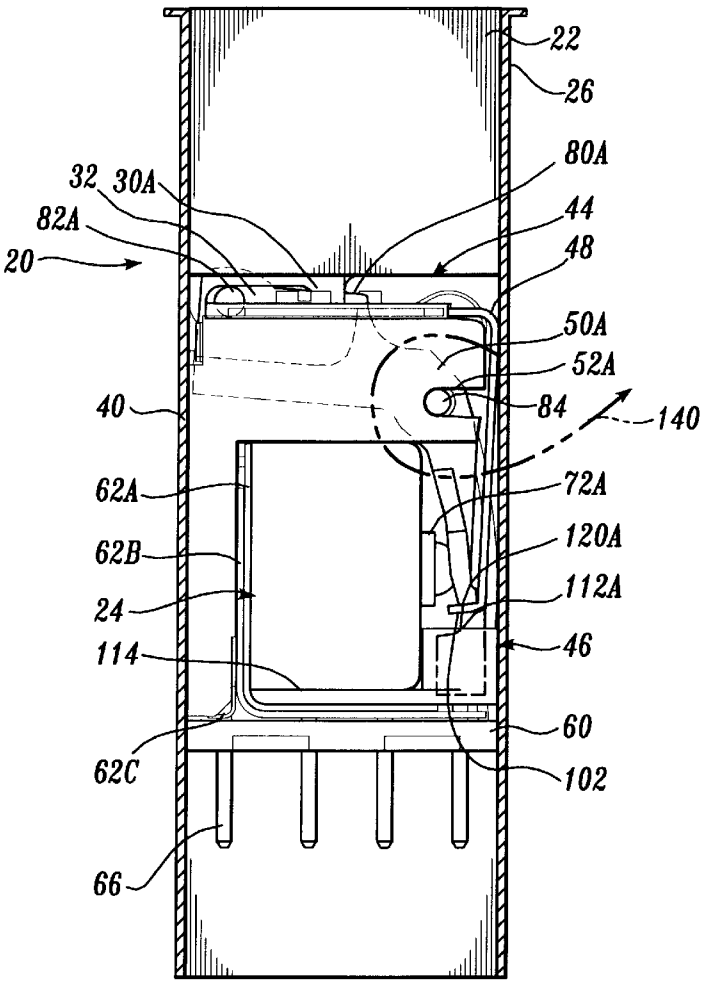
FIG. 5A is a side view of a push button switch formed in accordance with the present invention showing the switch in the closed circuit position.

Transition to the closed circuit position may be best understood by referring to FIGS. 5A and 5B. As seen in FIG. 5A, the pivot and slide pin 84 is firmly seated against the closed ends of the slots 52*a* and 52*b*. As the linear forces continue to be applied against the cap assembly 22, the downward force causes a rotation of the rocker 44 within the frame 40 about a pivot point defined by a longitudinal axis extending between the ends of the pivot and slide pin 84. As a result, the rocker 44 rotates in a counter-clockwise direction, indicated by the arrow 140 about the pivot and slide pin 84. The rotation of the rocker 44 causes the lower end of the rocker 44 to pivot away from the subminiature switch actuators 72*a*–72*d*, thereby causing the subminiature switches 30 to actuate into the closed circuit position. Further, as the rocker 44 rotates about the slide and pivot pin 84, the lower end of the rocker 44 compresses the two tactile sliders 112*a* and 112*b* against the compression springs 122*a*–122*d* to provide a "snap" feel when the foundation spring 48 slides over the top of the ramp portion 120*a* and 120*b* of each tactile slider 112*a* and 112*b*. Further, because the rocker 44 is in simultaneous contact with all of the subminiature switch actuators 72*a*–72*d*, the rocker 44 prevents individual actuation of individual subminiature switch actuators.

As may be best seen by referring to FIG. 5B, the free end is received within the yoke portion 138 of the heart guide 132 to selectively hold the switch 20 in the closed circuit position. As the cap assembly 22 was being depressed downwardly within the switch can 26, the free end of the heart guide wire 130 was sliding along the right side of the heart guide 132 until it reached the upper end of the heart guide 132, wherein the heart guide wire 130 was free to snap, in a counter-clockwise direction, over to the yoke portion 138 and was received therein to selectively hold the switch 20 into the open circuit position.

To unseat the free end of the heart guide wire 130 from the heart guide 132, and change the state of the switch 20 back into the open circuit position, the cap assembly 22 is depressed a second time. As a result, the free end of the heart guide wire 130 moves in a counter-clockwise direction and out of locking contact with the yoke portion 138 of the heart guide 132. As a result of the free end of the heart guide wire 130 being freed from the heart guide 132, the retention spring 88 and the foundation spring 48 causes the lower end of the rocker 44 to slide down the tactile slides 112*a* and 112*b* and back into contact with the subminiature switch actuators 72*a*–72*d*, thereby returning the switch 20 back into the open circuit position as seen in FIGS. 3A and 3B.

The previously described version of the present invention provides several advantages over switches currently available in the art. The orientation of the subminiature switch actuators within the subminiature switch can allow the end user to rearrange the external pin pattern to accommodate a multitude of connection pin configurations. This results in a switch that is convertible to accommodate multiple end user requirements and, therefore, is more versatile. The combination of the tactile mechanism 46 and the rocker 44 minimizes the possibility of non-simultaneous actuation of the subminiature switches. Thus, a switch formed in accordance with the present invention is also more reliable. Furthermore, a switch formed in accordance with the present invention has fewer parts and, therefore, is less costly to manufacture and again more reliable. Finally, such a switch uses a compound, dual axis of rotation rocker to provide precise mechanism timing. Thus, a push button switch formed in accordance with the present invention is economical to produce, has a high reliability and produces the customary and anticipated tactile response while changing the state of the switch.

From the foregoing description, it can be seen that a push button switch formed in accordance with the present invention incorporates many novel features and offers significant advantages over currently available switches. While presently preferred embodiments of the invention have been illustrated and described, it is to be understood that within the scope of the appended claims, various changes can be made therein without departing from the spirit of the invention.

The embodiments of the invention in which an exclusive property or privilege is claimed are defined as follows:

1. A push button switch comprising:

(a) a housing;

(b) a cap assembly reciprocably mounted within the housing;

(c) at least a first subminiature switch disposed within the housing, the first subminiature switch actuatable between an open circuit position and a closed circuit position by a subminiature switch actuator operatively attachcd thereto; and (d) a single piece actuator mounted within the housing and extending between the cap assembly and the subminiature switch actuator, the single piece actuator pivoting about first and second pivot points in response to a linear force to actuate the first subminiature switch between the open and closed circuit position.

2. The push button switch of claim 1, further comprising a plurality of subminiature switches disposed within the housing, wherein each of the plurality of subminiature switches has a subminiature switch actuator in contact with the single piece actuator for simultaneous actuation in response to the linear force and each of the plurality of subminiature switches actuatable between an open circuit position and a closed circuit position by the subminiature switch actuator.

3. The push button switch of claim 2, wherein each of the plurality of subminiature switches is disposed within the housing such that each subminiature switch actuator of the plurality of subminiature switches moves in a direction that is substantially normal to the motion of the cap assembly.

4. The push button switch of claim 3, wherein the first pivot point is located substantially near the contact between the single piece actuator and the subminiature switch actuators of the plurality of subminiature switches.

5. The push button switch of claim 4, wherein in response to the linear force, the single piece actuator pivots about the first pivot point and simultaneously translates within the housing along an axis that is substantially parallel to the motion of each subminiature switch actuator of the plurality of subminiature switches.

6. The push button switch of claim 5, wherein the single piece actuator pivots about the first pivot point while the single piece actuator remains in contact with each subminiature switch actuator of the plurality of subminiature switches to maintain the plurality of subminiature switches in the open circuit position.

7. The push button switch of claim 6, wherein the single piece actuator pivots about the second pivot point after the single piece actuator stops pivoting about the first pivot point and translating within the housing, there by actuating each subminiature switch actuator of the plurality of subminiature switches into the closed circuit position.

8. The push button switch of claim 3, further comprising a tactile response mechanism disposed within the housing, and in contact with the single piece actuator to produce a tactile response when each subminiature switch actuator of the plurality of subminiature switches is actuated between the open and closed circuit positions.

9. The push button switch of claim 8, wherein the tactile response mechanism comprises a tactile housing and a slide member reciprocably received within the tactile housing, the slide member in sliding contact with the single piece actuator for simultaneous tactile response and actuation of each subminiature switch actuator of the plurality of subminiature switches between the open and closed circuit positions.

10. The push button switch of claim 9, further comprising a hold down mechanism disposed within the housing and selectively in contact with a portion of the single piece actuator to selectively lock the pluarlity of subminiature switches into the closed circuit position.

11. The push button switch of claim 3, further comprising a hold down mechanism disposed within the housing and selectively in contact with a portion of the single piece actuator to selectively lock the plurality of subminiature switches into the closed circuit position.

12. A push button switch, comprising:

(a) a housing;

(b) a cap assembly reciprocably mounted within the housing;

(c) at least a first subminiature switch actuatable between an open circuit position and a closed circuit position by a plunger operatively attached thereto, the first subminiature switch being disposed within the housing such that actuation of the plunger is substantially normal to the motion of the cap assembly; and (d) a single piece actuator disposed within the housing and extending between the cap assembly and the plunger, the single piece actuator sequentially pivoting about first and second pivot points in response to a linear force to actuate the first subminiature switch between the open and closed circuit position.

13. The push button switch of claim 12, wherein in response to the linear force, the single piece actuator pivots a about the first pivot point and simultaneously translates within the housing along an axis that is substantially parallel to the motion of the plunger.

14. The push button switch of claim 13, wherein the single piece actuator pivots about the first pivot point while the single piece actuator remains in contact with the plunger to maintain the first subminiature switch in the open circuit position.

15. The push button switch of claim 14, wherein the single piece actuator pivots about the second pivot point a after the single piece actuator stops pivoting about the first pivot point and translating within the housing, thereby actuating the first subminiature switch into the closed circuit position.

16. The push button switch of claim 12, further comprising a tactile response mechanism disposed within the housing, and in contact with the single piece actuator to produce a tactile response when the first subminiature switch is actuated between the open and closed circuit positions.

17. The push button switch of claim 16, further comprising a hold down mechanism disposed within the housing and selectively in contact with a portion of the single piece actuator to selectively lock the first subminiature switch into the open circuit position.

18. The push button switch of claim 12, further comprising a hold down mechanism disposed within the housing and selectively in contact with a portion of the single piece actuator to selectively lock the first subminiature switch into the open circuit position.

19. A push button switch, comprising:

(a) a housing;

(b) a cap assembly reciprocably mounted within the housing;

(c) at least a first subminiature switch disposed within the housing, the first subminiature switch actuatable between an open circuit position and a closed circuit position by a plunger operatively attached thereto;

(d) a single piece disposed within the housing and extending between the cap assembly and the plunger the single piece actuator pivoting about first and second pivot points in response to a linear force to actuate the first subminiature switch between the open and closed circuit position; and (e) a tactile response mechanism disposed within the housing and in contact with the single piece actuator to produce a tactile response when the first subminiature switch is actuated between the open and closed circuit positions.

20. The push button switch of claim 19, further comprising a plurality of subminiature switches disposed within the housing, wherein each of the plurality of subminiature switches has a plunger in contact with the single piece actuator for simultaneous actuation in response to the linear force.

21. The push button switch of claim 20, wherein in response to the linear force, the single piece actuator pivots about the first pivot point and simultaneously translates within the housing along an axis that is substantially parallel to the motion of each plunger of the plurality of subminiature switches.

22. The push button switch of claim 21, wherein the single piece actuator pivots about the second pivot point after the single piece actuator stops pivoting about the first pivot point and translating within the housing, thereby actuating each of the plurality of subminiature switches into the open circuit position.

23. The push button switch of claim 22, further comprising a hold down mechanism disposed within the housing and selectively in contact with a portion of the single piece actuator to selectively lock each of the plurality of subminiature switches switch into the open circuit position.

24. A push button switch, comprising:

(a) a housing;

(b) a cap assembly reciprocably mounted within the housing;

(c) at least a first subminiature switch disposed within the housing, the first subminiature switch actuatable between an open circuit position and a closed circuit position by a plunger operatively attached thereto;

(d) a single piece actuator disposed within the housing and extending between the cap assembly and the plunger, the single piece actuator pivoting about first and second pivot points in response to a linear force to actuate the first subminiature switch between the open and closed circuit position; and (e) a hold down mechanism disposed within the housing and selectively in contact with a portion of the single piece actuator to selectively lock the first subminiature switch into the open circuit position.

25. The push button switch of claim 24, further comprising a tactile response mechanism disposed within the housing, and in contact with the single piece actuator to produce a tactile response when the first subminiature switch is actuated between the open and closed circuit positions.

26. A push button switch, comprising:

(a) a housing;

(b) a cap assembly reciprocably mounted within the housing;

(c) at least a subminiature switch disposed within the housing, the first subminiature switch actuatable between an open circuit position and a closed circuit position by a plunger operatively attached thereto;

(d) a single piece actuator disposed within the housing and extending between the cap assembly and the plunger, the single piece actuator pivoting about first and second pivot points in response to a linear force to actuate the first subminiature switch between the open and closed circuit position;

(e) a hold down mechanism disposed within the housing and selectively in contact with a portion of the single piece actuator to selectively lock the first subminiature switch into the open circuit position; and (f) a tactile response mechanism disposed within the housing and in contact with the single piece actuator to produce a tactile response when the first subminiature switch is actuated between the open and closed circuit positions.

27. A push button switch comprising:

(a) a housing;

(b) a cap assembly reciprocably mounted within the housing;

(c) at least a first subminiature switch disposed within the housing, the first subminiature switch actuatable between an open circuit position and a closed circuit position by a subminiature switch actuator operatively attached thereto;

(d) an actuator mounted within the housing and extending between the cap assembly and the subminiature switch actuator, the actuator pivoting about first and second pivot points in response to a linear force to actuate the first subminiature switch between the open and closed circuit position; and (e) a plurality of subminiature switches disposed within the housing, wherein each of the plurality of subminiature switches has a subminiature switch actuator in contact with the single piece actuator for simultaneous actuation in response to the linear force and each of the plurality of subminiature switches actuatable between an open circuit position and a closed circuit position by the subminiature switch actuator wherein each of the plurality of subminiature switches is disposed within the housing such that each subminiature switch actuator of the plurality of subminiature switches moves in a direction that is substantially normal to the motion of the cap assembly, wherein the first pivot point is located substantially near the contact between the actuator and the subminiature switch actuators of the plurality of subminiature switches, wherein in response to the linear force, the single piece actuator pivots about the first pivot point and simultaneously translates within the housing along an axis that is substantially parallel to the motion of each subminiature switch actuator of the plurality of subminiature switches.

28. The push button switch of claim 27, wherein the actuator pivots about the first pivot point while the actuator remains in contact wit h each subminiature switch actuator of the plurality of subminiature switches to maintain the plurality of subminiature switches in the open circuit position.

29. The push button switch of claim 28, wherein the single piece actuator pivots about the second pivot point after the actuator stops pivoting about the first pivot point and translating within the housing, thereby actuating each subminiature switch actuator of the plurality of subminiature switches into the closed circuit position.

30. A push button switch, comprising:

(a) a housing;

(b) a cap assembly reciprocably mounted within the housing;

(c) at least a first subminiature switch disposed within the housing, the first subminiature switch actuatable between an open circuit position and a closed circuit position by a subminiature switch actuator operatively attached thereto;

(d) an actuator mounted within the housing and extending between the cap assembly and the subminiature switch actuator the actuator pivoting about first and second pivot points in response to a linear force to actuate the first subminiature switch between the open and closed circuit position;

(e) a plurality of subminiature switches disposed within the housing, wherein each of the plurality of subminiature switches has a subminiature switch actuator in contact with the actuator for simultaneous actuation in response to the linear force and each of the plurality of subminiature switches actuatable between an open circuit position anti a closed circuit position by the subminiature switch actuator, wherein each one of the plurality of subminiature switches is disposed within the housing such that each subminiature switch actuator of the plurality of subminiature switches moves in a direction that is substantially normal to the motion of the cap assembly; and (f) a tactile response mechanism disposed within the housing and in contact with the actuator to produce a tactile response when each subminiature switch actuator of the plurality of subminiature switches is actuated between the open and closed circuit positions, wherein the tactile response mechanism comprises a tactile housing and a slide member reciprocably received within the tactile housing, the slide member in sliding contact with the actuator for simultaneous tactile response and actuation of each subminiature switch actuator of the plurality of said miniature switches between the open and closed circuit positions.

31. The push button switch of claim 30, further comprising a hold down mechanism disposed within the housing and selectively in contact with a portion of the actuator to selectively lock the plurality of subminiature switches into the closed circuit position.

32. A push button switch, comprising:

(a) a housing;

(b) a cap assembly reciprocably mounted within the housing;

(c) at least a first subminiature switch actuatable between an open circuit position and a closed circuit position by a plunger operatively attached thereto, the first subminiature switch being disposed within the housing such that actuation of the plunger is substantially normal to the motion of the cap assembly; and (d) an actuator disposed within the housing and extending between the cap assembly and the plunger, the actuator sequentially pivoting about first and second pivot points in response to a linear force to actuate the first subminiature switch between the open and closed circuit position, wherein in response to the linear force, the actuator pivots about the first pivot point and simultaneously translates within the housing along an axis that is substantially parallel to the motion of the plunger.

33. The push button switch of claim 32, wherein the actuator pivots about the first pivot point while the actuator remains in contact with the plunger to maintain the first subminiature switch in the open circuit position.

34. The push button switch of claim 33, wherein the actuator pivots about the second pivot point after the actuator stops pivoting about the first pivot point and translating within the housing, thereby actuating the first subminiature switch into the closed circuit position.

35. A push button switch, comprising:

(a) a housing;

(b) a cap assembly reciprocably mounted within the housing;

(c) at least a first subminiature switch disposed within the housing, the first subminiature switch actuatable between an open circuit position and a closed circuit position by a plunger operatively attached thereto;

(d) an actuator disposed within the housing and extending between the cap assembly and the plunger, the actuator pivoting about first and second pivot points in response to a linear force to actuate the first subminiature switch between the open and closed circuit position;

(e) a plurality of subminiature switches disposed within the housing, wherein each subminiature switch having a plunger in contact with the actuator for simultaneous actuation in response to the linear force; and (f) a tactile response mechanism disposed within the housing and in contact with the actuator to produce a tactile response when the first subminiature switch is actuated between the open and closed circuit positions, wherein in response to the linear force, the actuator pivots about the first pivot point and simultaneously translates within the housing along an axis that is substantially parallel to the motion of each plunger of the plurality of subminiature switches.

36. The push button switch of claim 35, wherein the actuator pivots about the second pivot point after the actuator stops pivoting about the first pivot point and translating within the housing, thereby actuating each of the plurality of subminiature switches into the open circuit position.

37. The push button switch of claim 36, further comprising a hold down mechanism disposed within the housing and selectively in contact with a portion of the actuator to selectively lock each of the plurality of subminiature switches switch into the open circuit position.

* * * * *

UNITED STATES PATENT AND TRADEMARK OFFICE

CERTIFICATE OF CORRECTION

PATENT NO. : 6,028,279

DATED : February 22, 2000

INVENTOR(S) : M.J. Suryan et al.

It is certified that error appears in the above-identified patent and that said Letters Patent is hereby corrected as shown below:

Title page,

| | | |
|---|---|---|
| [56] Pg. 1, col. 2 | Refs. Cited (U.S. Pats, Item 17) | "5,202,607 11/1993 Cummings et al." should read --5,262,607 11/1993 Cummins et al.-- |
| 9 (Claim 1, | 3 line 1) | after "switch" insert --,-- |
| 9 (Claim 7, | 50 line 4) | "there by" should read --thereby-- |
| 9 (Claim 8, | 54 line 2) | after "housing" delete "," |
| 10 (Claim 10, | 2 line 4) | "pluarlity" should read --plurality-- |
| 10 (Claim 13, | 28 line 3) | before "about" delete "a" |
| 10 (Claim 15, | 37 line 2) | before "after" delete "a" |
| 10 (Claim 19, | 64 line 9) | after "piece" insert --actuator-- |
| 10 (Claim 19, | 65 line 10) | after "plunger" insert --,-- |

UNITED STATES PATENT AND TRADEMARK OFFICE

CERTIFICATE OF CORRECTION

PATENT NO. : 6,028,279

DATED : February 22, 2000

INVENTOR(S) : M.J. Suryan et al.

It is certified that error appears in the above-identified patent and that said Letters Patent is hereby corrected as shown below:

| | | |
|---|---|---|
| 11 (Claim 26, | 60 line 5) | after "at least a" insert --first-- |
| 12 (Claim 27, | 35 line 23) | after "actuator" insert --,-- |
| 12 (Claim 28, | 51 line 3) | "wit h" should read --with-- |
| 13 (Claim 30, | 6 line 12) | after "actuator" insert --,-- |
| 13 (Claim 30, | 16 line 22) | "anti" should read --and-- |

Signed and Sealed this

Tenth Day of April, 2001

*Attest:*

Nicholas P. Godici

NICHOLAS P. GODICI

*Attesting Officer*

*Acting Director of the United States Patent and Trademark Office*